US005524556A

United States Patent [19]

Rowlette et al.

[11] Patent Number: 5,524,556

[45] Date of Patent: Jun. 11, 1996

[54] INDUCED DRAFT FAN CONTROL FOR USE WITH GAS FURNACES

[75] Inventors: Mitchell R. Rowlette, Berea; Youn H. Ting, Lexington; Walter H. Bailey, Versailles; Ronald E. Garnett, Lexington, all of Ky.

[73] Assignee: Texas Instruments Incorporated, Dallas, Tex.

[21] Appl. No.: 489,274

[22] Filed: Jun. 9, 1995

[51] Int. Cl.[6] ..... G05D 7/06

[52] U.S. Cl. ..... 110/162; 110/185; 110/159; 236/49.1

[58] Field of Search ..... 110/162, 185, 110/159; 236/49

[56] References Cited

U.S. PATENT DOCUMENTS

| | | | |
|---|---|---|---|
| 3,924,605 | 12/1975 | Weinman et al. | 110/162 |
| 4,185,685 | 1/1980 | Giberson | 110/162 |
| 4,204,832 | 5/1980 | Miller | 110/162 |
| 4,205,631 | 6/1980 | Parker | 110/162 |
| 4,402,303 | 9/1983 | Koenneman | 110/162 |
| 4,485,746 | 12/1984 | Erlandsson | 110/162 |
| 4,487,137 | 12/1984 | Horvat et al. | 110/162 |
| 4,638,233 | 1/1987 | Erdman . | |
| 4,648,551 | 3/1987 | Thompson et al. . | |
| 4,688,547 | 8/1987 | Ballard et al. . | |
| 4,703,747 | 11/1987 | Thompson et al. . | |
| 4,789,330 | 12/1988 | Ballard et al. | 110/162 |
| 4,829,703 | 5/1989 | Watson et al. | 110/162 |
| 4,860,231 | 8/1989 | Ballard et al. . | |
| 4,907,737 | 3/1990 | Williams | 110/162 |
| 5,272,427 | 12/1993 | Nold et al. . | |
| 5,279,234 | 1/1994 | Bender et al. | 110/162 |
| 5,331,944 | 7/1994 | Kujawa et al. . | |

OTHER PUBLICATIONS

Article Entitled: Controlling A DC Motor With A Low-End Micro-Controller By J. Nicolai & T. Castagnet (Intelligent Motion—Jun. 1993 Proceedings).

*Primary Examiner*—Marguerite Macy

*Attorney, Agent, or Firm*—Russell E. Baumann; Richard L. Donaldson; René E. Grossman

[57] ABSTRACT

A gas fired furnace system (10) has a controller (14) controlling the supply of gas through a gas valve (12) and air for combustion by means of an induced air draft fan (28), ignition of the gas by means of ignitor (22), the delivery of heated air from a heat exchanger (20) by means of an air blower (34) in response to signals from a thermostat (42). A selected constant flow of air for combustion is provided by controlling the speed of the motor driving the induced motor fan (28) despite changes which may occur in back pressure. Induced draft fan motor parameters proportional to motor torque and motor speed are read on an ongoing basis and inputted to controller (14) which computes a desired voltage and compares that with referenced data stored in the controller memory and makes corrections to the speed of the induced draft fan motor to maintain the constant air flow. The motor speed and motor torque are also monitored to ensure that they are within selected limits indicative of safe operation and responsive to this input energization of a relay (KM1) is controlled to deenergize the gas valve and ignition.

6 Claims, 9 Drawing Sheets

INDUCED DRAFT FAN CONTROL FOR USE WITH GAS FURNACES

FIELD OF THE INVENTION

This invention relates generally to gas furnace controls and more specifically to induced draft fan controls used with such furnaces.

Air to be used in the combustion process of a furnace needs to be provided at a given rate relative to fuel in order to optimize the efficiency of a furnace. However, installations of gas furnaces vary from one site to another causing changes in back pressure which affect the amount of air provided by the fan at a given speed. Back pressure for a given installation is dependent upon a number of factors related to the vent system installation including individual fan designs, housing designs, length of the vent, number of elbows in the duct, and the like. In addition, back pressure for a given installation can be further increased during use by blockages caused by such things as birds' nests, wind conditions and so on. As a result, and since the flow rate of air and back pressure are inversely related, individual draft fans are generally arranged to provide adequate air flow for the worst case of back pressure and consequently more air than is required at other conditions and therefore operate inefficiently for vents having less than worst case back pressures. This inefficiency also results in hotter vented combustion products and can present problems for plastic vent materials.

SUMMARY OF THE INVENTION

It is an object of the present invention to provide a control which overcomes the deficiencies of the prior art noted above. Another object is the provision of a furnace control which will permit operation of the furnace essentially at maximum efficiency. Another object is the provision of a speed control of an induced draft fan motor in order to obtain a selected, constant rate of combustion air flow relative to any given fuel flow in a gas furnace. Yet another object is the provision of such a control which is reliable, inexpensive and one which adapts to changes in back pressure to maintain a constant selected flow rate. Another object of the invention is the provision of a control system which eliminates the need for a conventional pressure switch to determine that adequate pressure conditions exist to ensure the venting of combustion products, particularly carbon monoxide. Still another object is the provision of an induced draft fan control having ancillary features including diagnostics relating to motor operation and protection, such as overcurrent, undercurrent and the like as well as system operation such as maximum and minimum flow rates and maximum static pressure.

Briefly, in accordance with the invention, an inexpensive DC motor is used to provide an induced flow rate of air with the motor speed torque being measured on an ongoing basis. For a given flow rate and a given motor-fan combination, there is a curve which relates motor speed to motor torque over a suitable range of back pressure on the fan. According to the invention, a microprocessor control (with the aforementioned torque-speed curve stored in its memory) reads the motor speed and torque, computes the desired speed based on the actual torque and the curve, and then adjusts the motor drive to achieve the desired operating point.

The speed of a DC motor is commonly determined in various ways. One such method relies on the fact that when a DC motor is rotating, it generates a DC voltage proportional to its rotational speed. That voltage, commonly referred to as the electromotive force voltage or EMF, is used in the preferred embodiment to determine the motor speed. Other methods involve some means of counting the number of motor shaft rotations within a given time period.

The torque of a DC motor can also be determined in various ways. Several methods rely on the fact that motor torque is directly proportional to motor current. Motor current, which in turn can be measured in several ways, is used in the preferred embodiment to determine motor torque. Motor torque can also be measured based on the physical relation which states that motor torque equals motor inertia times motor acceleration. For a given motor-fan combination, the inertia at a given speed is predictable, so the torque can be determined by measuring the response of a motor to a step function.

In the preferred embodiment, the motor speed of a DC motor is controlled by pulse width modulating (PWM) an N-channel MOSFET connected between the applied voltage and the motor. Motor speed is read by reading the EMF voltage on the high side of the motor (MOSFET source) when the MOSFET is turned off. In one embodiment of the invention, the PWM wave form is altered periodically to extract data from the motor. During the sample period, three parameters, motor current, applied voltage and EMF voltage are read consecutively, each for a fixed amount of time. The sampling period starts as soon as the motor is turned on. A fixed number of samples, (e.g., 32) of the motor current is taken. After the last sample, the motor is immediately turned off. The applied voltage is then measured for a fixed number of samples (e.g., 16) while the EMF voltage stabilizes. Then the EMF voltage is measured for a given number of samples (e.g., 16). After the last EMF voltage sample, the system returns to the normal PWM mode. Since the sampling process alters the operation of the motor, each sample period is separated by at least N PWM cycles where N is chosen to be between 10 and 1000 depending on PWM frequency. The data taken during the sample period is summed and averaged for each variable.

According to a of the invention, a feed-forward voltage compensation algorithm is employed to allow the motor to operate over a wider voltage range (e.g. 18–30 volts AC). According to yet another feature, the speed of the motor is reduced at the inception of combustion to allow the flame to ignite and stabilize. Once the flame has stabilized, the motor speed is ramped back up to the pre-combustion speed setting. This speed ramp typically lasts 5 to 10 seconds and is adjusted to meet the needs of the particular furnace.

According to still another feature of this invention, a relay is used to take the place of the pressure switch contacts. This feature offers a significant cost savings to the furnace manufacturer and greatly reduces the field problems associated with the pressure switch. The relay is only actuated when the microprocessor determines that the induced draft fan is operating safely at the desired airflow rate and is placed in series with the gas valve to provide an alternate means of interrupting the flow of gas.

According to a modified embodiment of the invention, the data sampling process "piggy backs" onto the pulse width modulated wave form. The PWM wave form received by the motor is not changed by the sampling process.

Additional objects and advantages of the invention will be set forth in part in the description which follows and in part will be obvious from the description. The objects and advantages of the invention may be realized and attained by means of the instrumentalities, combinations and methods particularly pointed out in the appended claims.

BRIEF DESCRIPTION OF THE DRAWINGS

The accompanying drawings, which are incorporated in and constitute a part of the specification illustrates preferred embodiments of the invention and, together with the description serve to explain the objects, advantages and the principles of the invention. In the drawings.

DETAILED DESCRIPTION OF PREFERRED EMBODIMENTS

Figure 1:
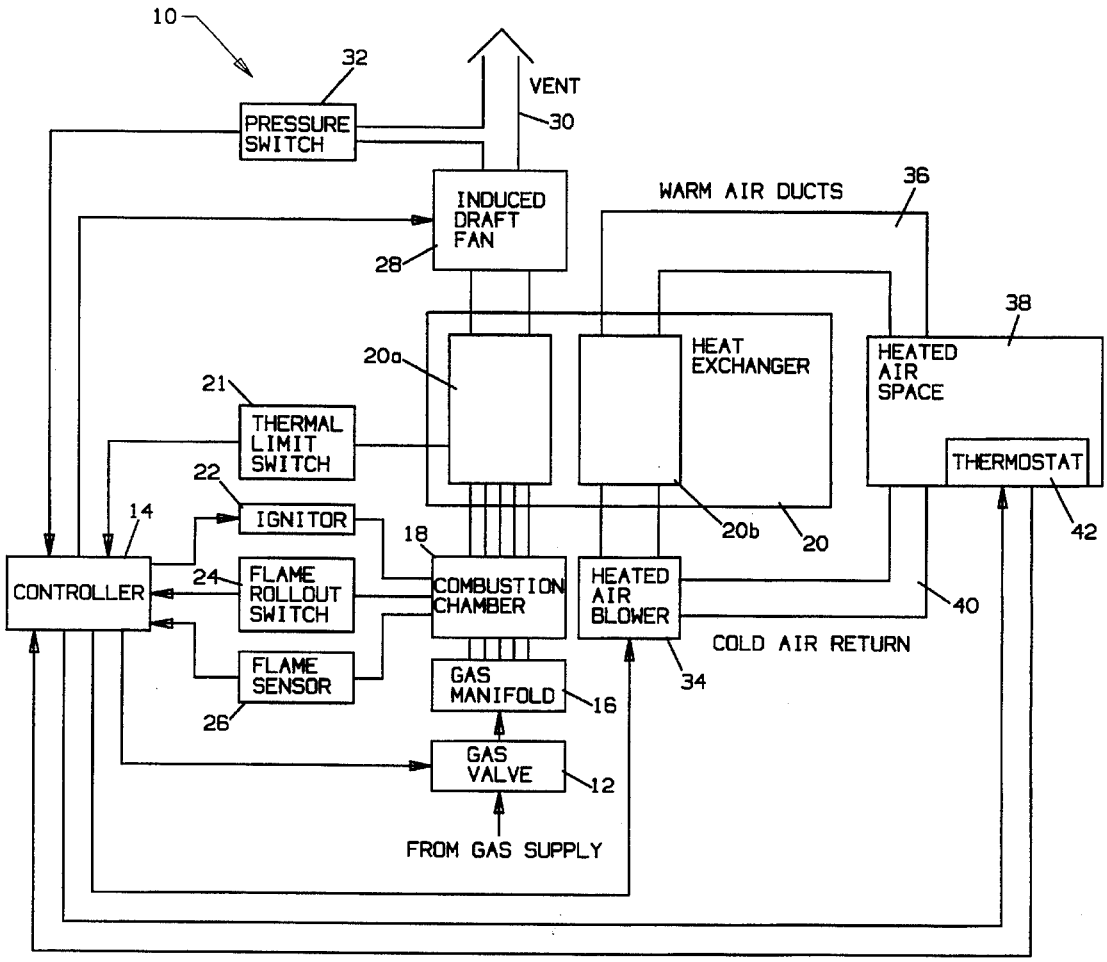
FIG. 1 is a schematic block diagram of a gas furnace system utilizing a control made in accordance with the invention.

With particular reference to FIG. 1, a block diagram of a gas furnace system 10 is shown in which a gas valve 12 turns on and off gas from a supply line as controlled by controller 14. Gas from valve 12 passes into a manifold 16 and is distributed to the burners of the system (not shown), typically anywhere from one to five. The gas flow rate can be determined from the gas pressure at the manifold, the number of nozzles, and the size of the orifice in each nozzle. The gas is delivered to a combustion chamber 18, typically an area defined between the gas nozzles and the entrance to the heat exchanger 20. Associated with combustion chamber 18 is an ignitor 22 which ignites the gas as it comes out of the gas manifold. Safety features include a flame rollout switch 24 to ensure that the flame is contained within the combustion chamber and a flame sensor 26 used to provide an indication of when flame is present. Switch 24 and sensor 26 signals are inputted to controller 14 which turns off the gas valve upon the occurrence of a fault condition in a known manner.

After the flame is generated in the combustion chamber it is pulled into one side 20*a* of heat exchanger 20 by induced draft fan 28 and exhausted into vent 30. A conventional pressure switch 32 may be attached between the induced draft fan 28 and vent 30 as a safety measure to ensure that sufficient air flow is present to prevent excessive hazardous combustion products. When adequate pressure is detected the controller is enabled to turn on the gas valve and initiate ignition.

On the other side 20*b* of heat exchanger 20 a heated air blower 34 blows air through a separate path in the heat exchanger and into warm air ducts 36, heated air space 38 back through cold air return ducts 40. A thermostat 42 located in the heated air space provides input back to controller 14 to either turn on or turn off the combustion process and the air blower 34.

Figure 2A:
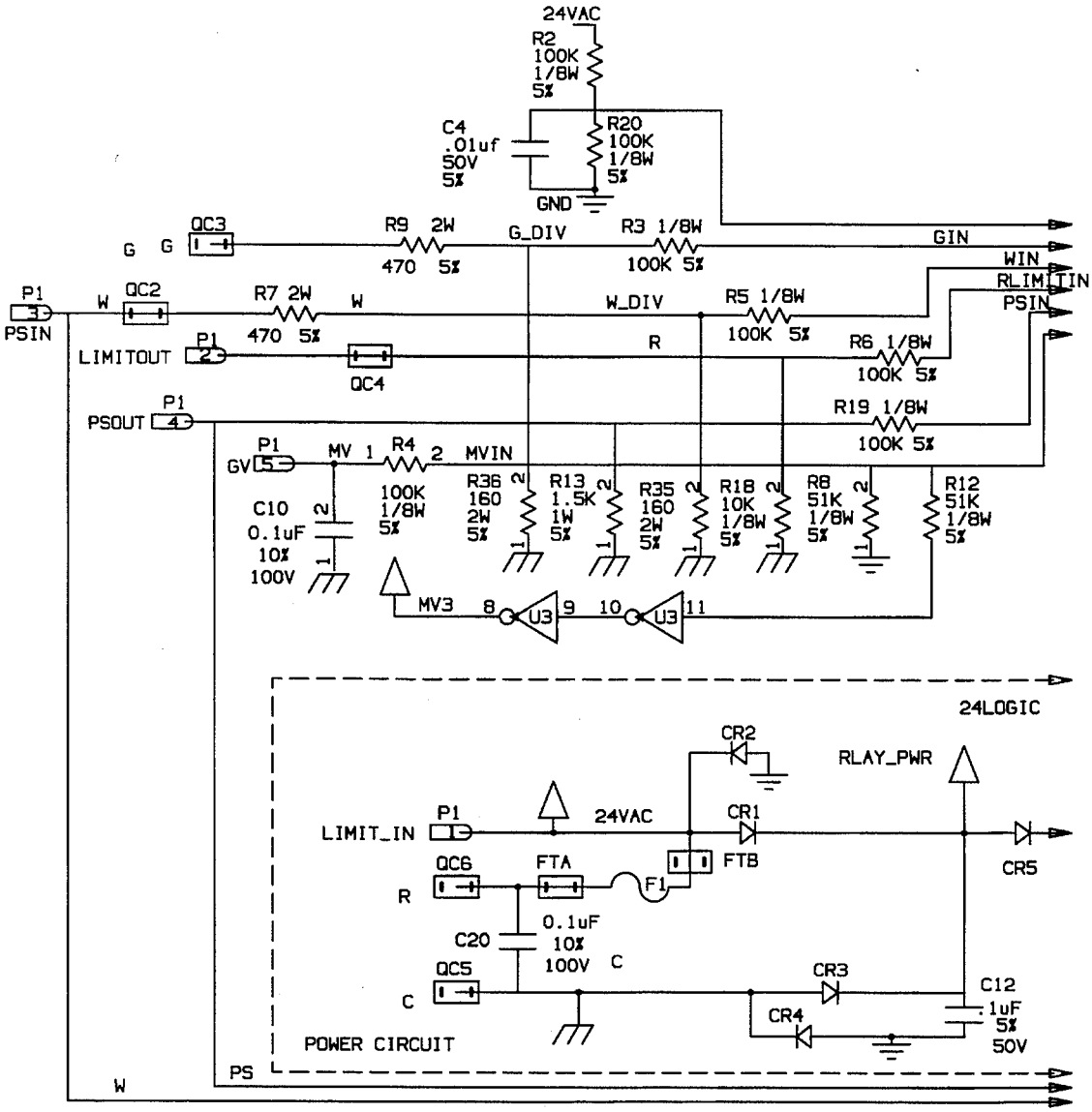
FIGS. 2*a*–2*f* together comprise a schematic circuit diagram of a control made in accordance with the invention.
Figure 2B:
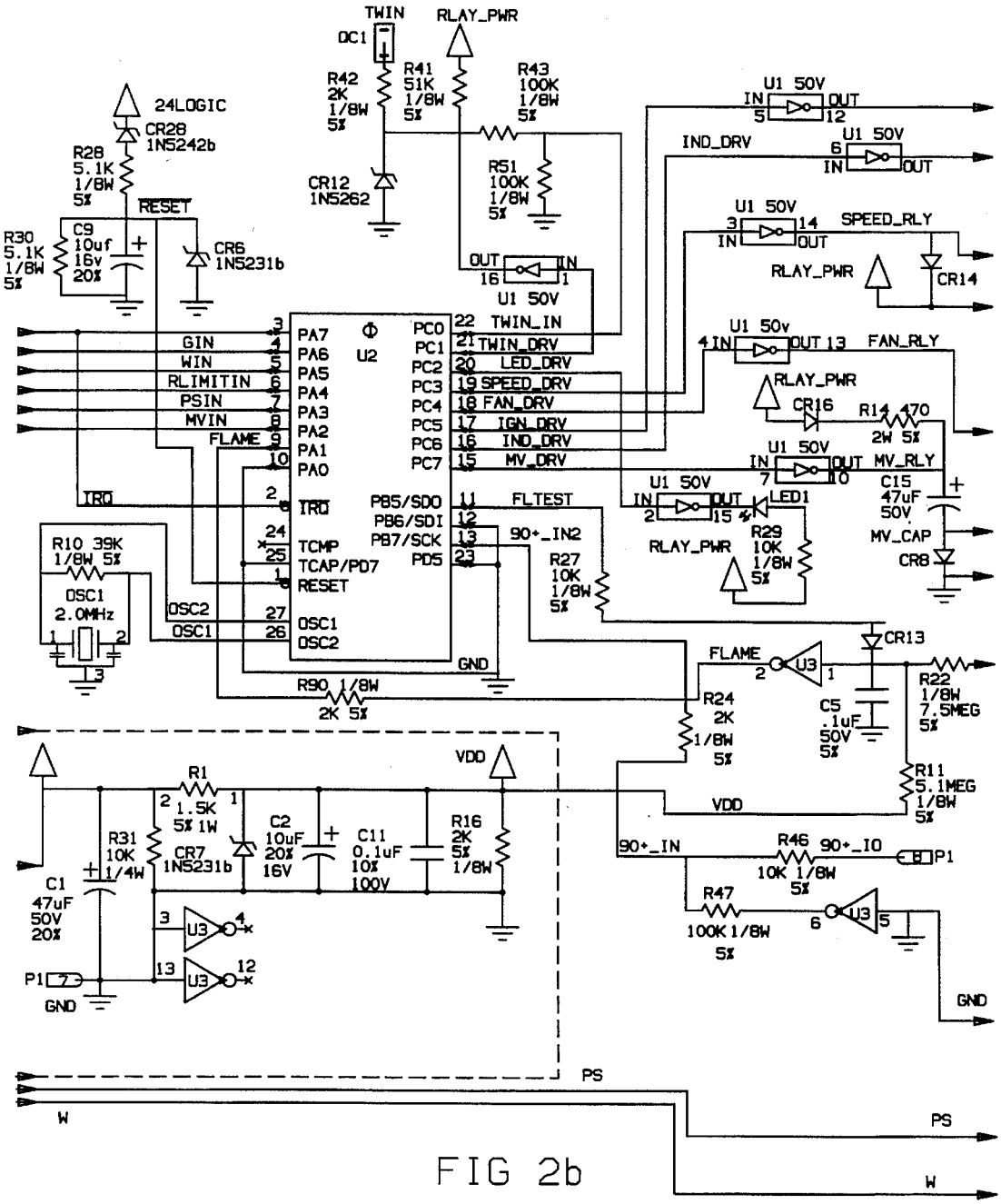
Figure 2C:
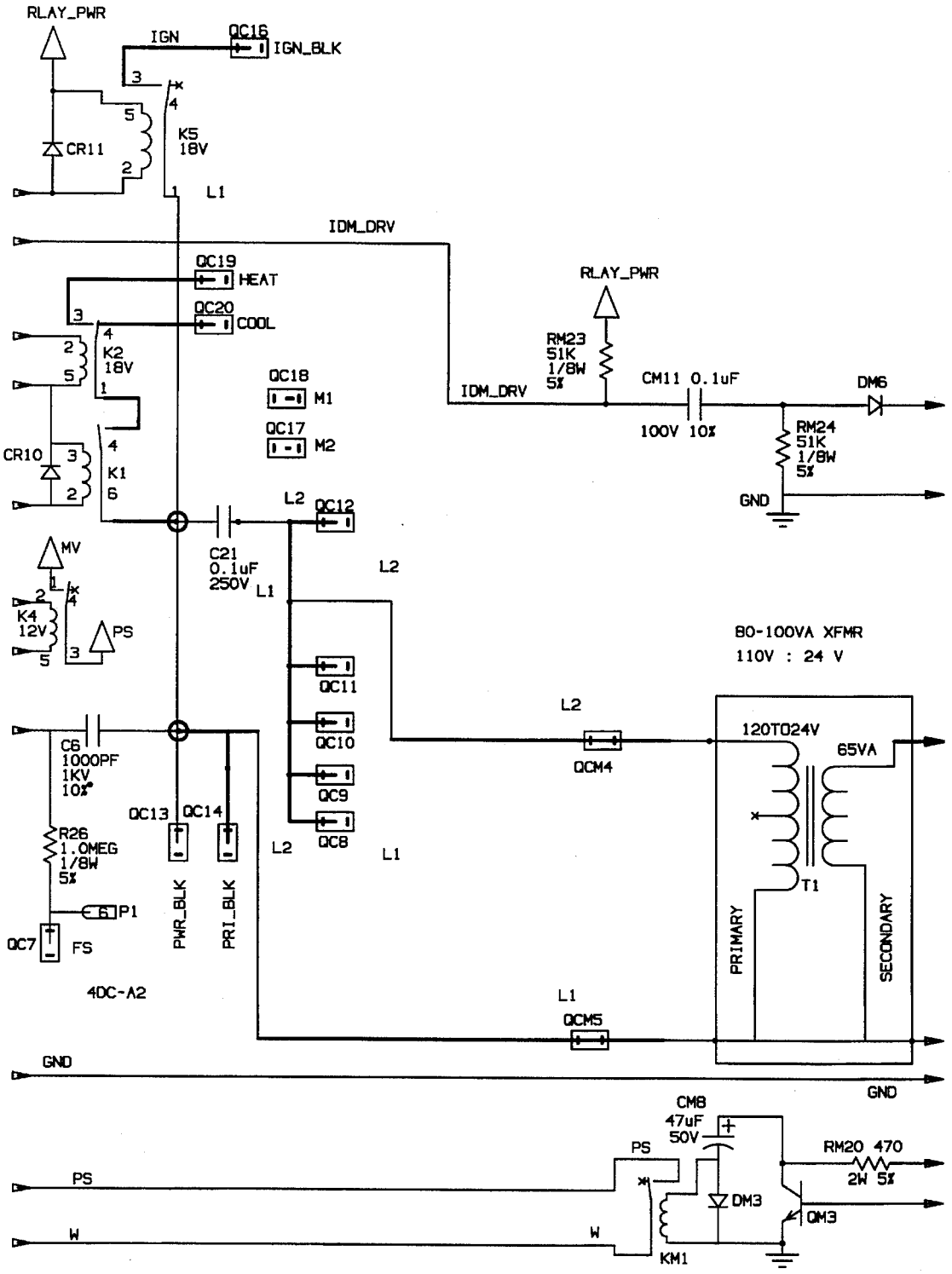
Figure 2D:
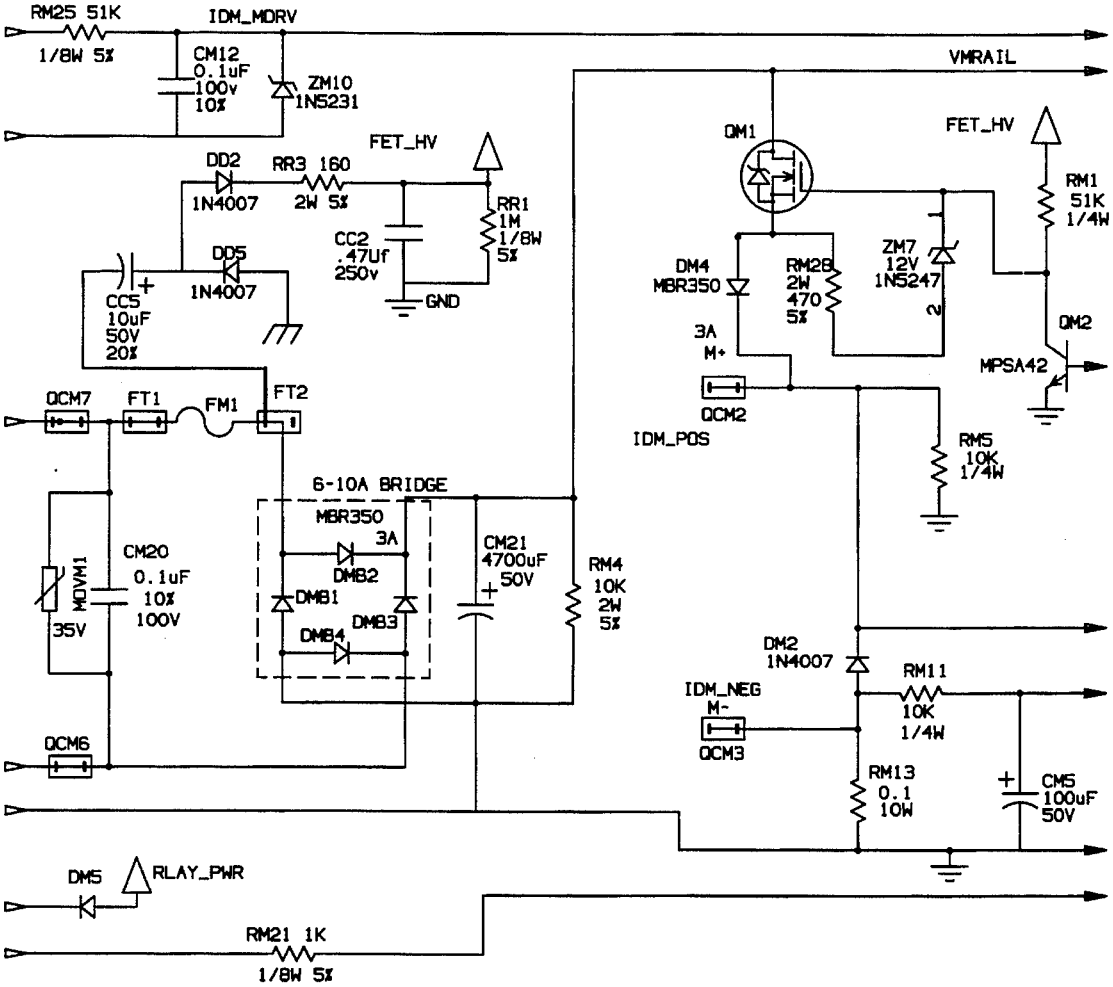
Figure 2E:
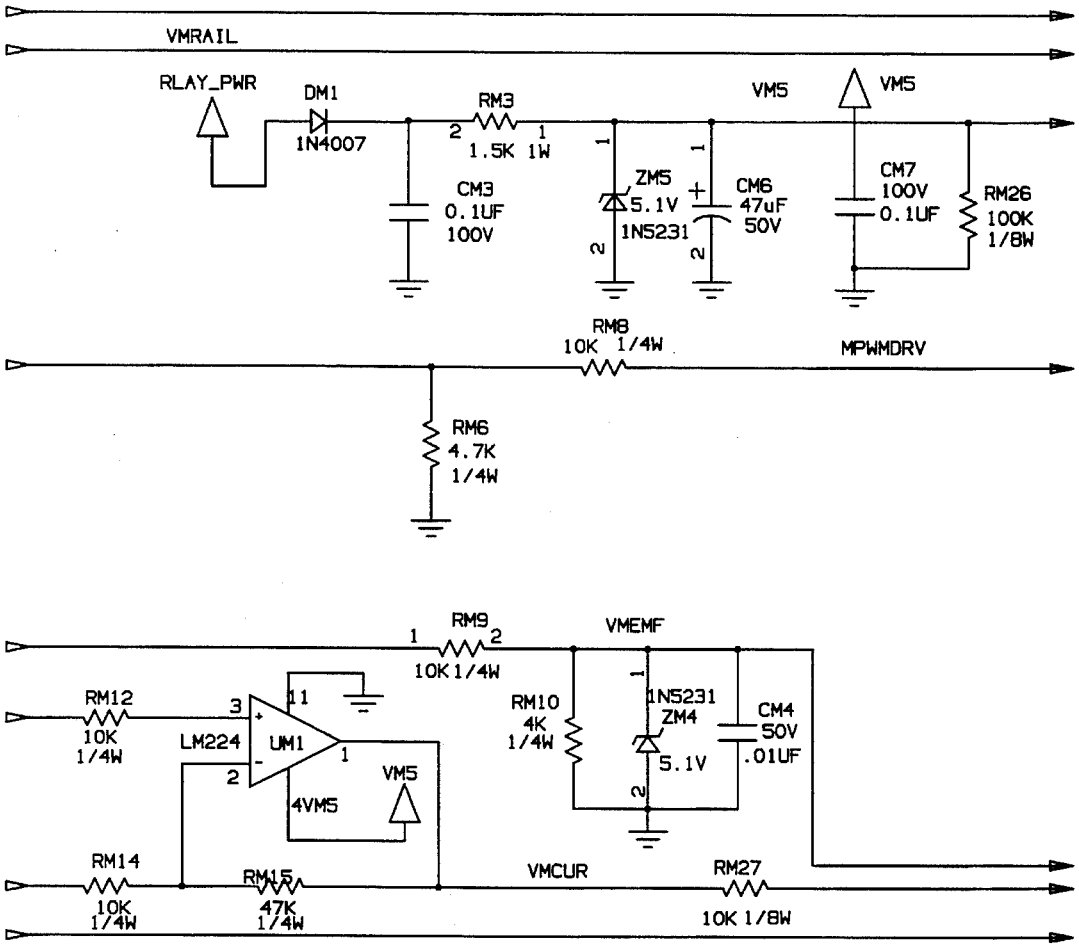
Figure 2F:
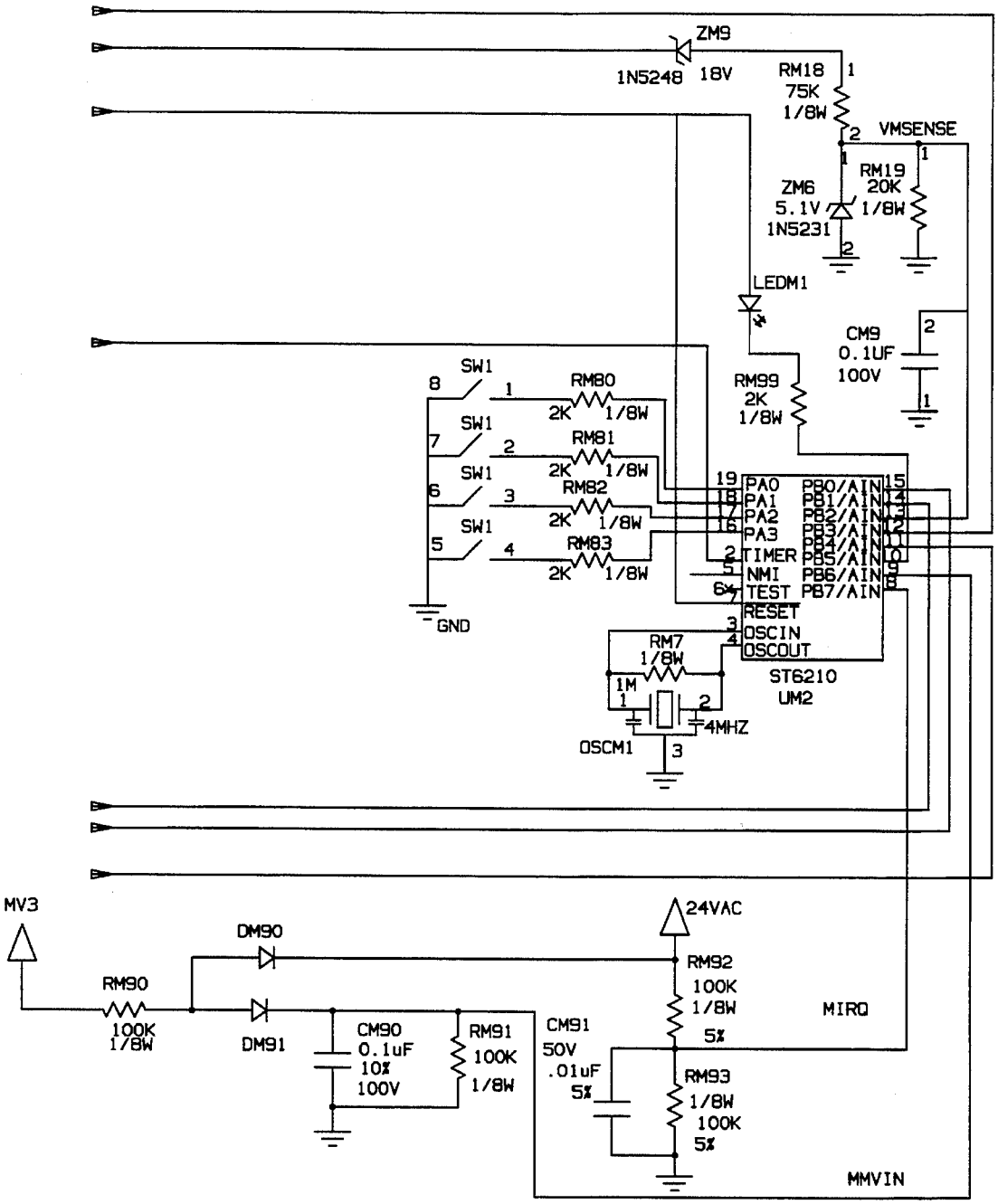

As stated supra, the function of the induced draft fan is to blow the combustion product through the heat exchanger and out through the vent as well as to control air flow into the combustion process. The back pressure of the induced draft fan which affects the delivery rate of air for a given fan speed is a variable depending upon various fixed factors such as the number of bends placed in the duct, the size of the duct used, the type of cover placed over the top of the vent and so on, and variable factors such as wind velocity and to some extent barometric pressure. A control made in accordance with the invention, as will be explained below, provides a constant flow rate independently of back pressure, one which will adapt to whatever back pressure is caused by the fixed factors referenced above as well as to back pressures caused by ongoing variable factors. This avoids wasting energy caused by blowing more air than is required through the combustion chamber with concomitant extra energy expended in blowing air that is not needed as well as loss of heat due to the cooling effect of the extra air. Furthermore, constant flow at an optimum flow rate minimizes production of hazardous combustion products.

with particular reference to FIGS. 2*a*, 2*b* the circuit shown in the schematic represents a combination of a gas furnace controller and an induced draft fan controller in which pressure switch 32 is replaced by pressure switch simulation means to be discussed below. The necessary logical interfaces defined in this approach are the induced draft fan enable signal and the simulated pressure switch enable signal.

With regard to the induced draft fan controller, FIG. 2*b*, beginning with the 120 volt AC power terminals L1 and L2, AC power is transformed to 24 volts AC through the transformer T1. A metal oxide varistor (MOV) labeled MOVM1 is connected across the transformer secondary to limit excessive transient voltage surges that are coupled across the transformer (e.g., lightning spikes). Capacitor CM20 which is also connected across the transformer secondary provides differential mode filtering for high frequency signals which may be coupled through the transformer.

The power is fed from the transformer secondary through fuse FM1 to a bridge rectifier. The fuse is a safety device which opens in the event excessive current is drawn as a result of a shorted component, shorted wiring or excessive load. Diodes DMB1, DMB2, DMB3 and DMB4 form a full wave bridge rectifier which converts the AC voltage supplied by the transformer into full wave rectified DC power. Capacitor CM21 integrates the rectified DC and removes the voltage ripple from the rectified DC power. Resistor RM4 which is in parallel with CM21 is a bleeder resistor which provides a minimum load and also discharges CM21 when the applied power is removed. The voltage generated by this supply is named VMRAIL and is used to drive the induced draft fan motor.

After AC power from the secondary of T1 passes through fuse FM1 it is also used as the input to a voltage doubler to generate a high voltage supply FET_HV used to turn on the gate of a N-channel power MOSFET QM1 which switches the power to the motor on and off. This voltage doubler is comprised of capacitors CC2 and CC5, resistors RR1 and RR3, and diodes DD2 and DD5. The AC wave form from the transformer secondary is coupled via fuse FM1 and capacitor CC5 into the common node of diodes DD2 and DD5. On negative half cycles diode DD5 conducts charging CC5 to the half cycle peak voltage minus the diode drop from DD5. On positive half cycles the voltage from the transformer plus the stored voltage on capacitor CC5 causes the voltage at the common node of diodes DD2 and DD5 to go to twice the peak AC voltage minus a diode drop. Diode DD5 is strongly reverse biased and does not conduct. Diode DD2 is forward biased and charges CC2 through resistor RR3 to twice the peak voltage minus two diode drops. Resistor RR1 is a high valued bleeder resistor which discharges CC2 when power is removed.

The logic power supply is derived from a second power transformer whose secondary winding is connected to the terminals marked QC5 and QC6 shown in FIG. 2*a*. Capacitor C20 provides filtering of high frequency components that may be coupled through the transformer. Fuse F1 is a safety device which opens if excessive current is drawn from the transformer secondary. The power is then full wave rectified by a bridge rectifier comprised of diodes CR1, CR2, CR3 and CR4. Capacitor C12 provides additional high frequency filtering at the output of the bridge rectifier for high frequency components on the power line which may be coupled through the power transformer. This full wave rectified voltage is labeled RLAY_PWR and is used in this predominantly unfiltered state as a power source for the DC relays used in the system and to be discussed infra. RLAY_PWR is further rectified by diode CR5 whose output is integrated by capacitor C1 which removes the ripple from the rectified voltage. Diode CR5 also decouples the filtering action of capacitor C1 from RLAY_PWR. This filtered DC is named 24LOGIC on the schematic. Resistor R31 is a bleeder resistor which provides a minimum load and also discharges capacitor C1 when power is removed. The low voltage logic supply VDD is generated from 24LOGIC by the dropping resistor R1 and zener diode CR7. The zener voltage of diode CR7 sets the value of the VDD voltage. Resistor R1 sets the combined current for the load and the current shunted through diode CR7. Capacitor C2 provides additional filtering which removes most of the ripple from the supply VDD and provides a charge storage reservoir which can supply sudden current surge demands for the VDD supply without appreciably affecting the supply voltage. Capacitor C11 provides additional filtering of any high frequency signal components which might be present on the VDD supply. Resistor R16 discharges capacitors C2 and C11 when the power is removed.

The EMF generated by the induced draft fan motor during the non-driven or "coasting" segment of the period labeled VMEMF is sampled by an analog input of the microprocessor UM2 (FIG. 2*b*). This signal is coupled from the motor terminal M+ labeled IDM_POS at terminal QCM2 through an attenuator/filter formed by resistors RM9, RM10 and CM4. Zener diode ZM4 limits the voltage at the microprocessor input to a voltage level which will not damage the microprocessor.

The current drawn by the motor is sensed by monitoring the voltage across resistor RM13. Resistor RM13 which forms a voltage divider with the motor is a low value resistor through which the motor's current passes during the driven segment of the period. This voltage, which is proportional to the motor current, is low pass filtered by resistor RM11 and capacitor CM5. The filtered signal voltage is then amplified by an amplifier comprised of UM1 and resistors RM12, RM14 and RM15. The output of the amplifier labeled VMCUR is fed into an analog input of the microprocessor.

The voltage used to drive the motor, VMRAIL, is also sampled. Zener diode ZM9 subtracts a fixed DC voltage from VMRAIL. Resistors RM18 and RM19 and capacitor CM9 form an attenuator/filter for the voltage VMRAIL$-V_{ZM9}$ providing a voltage labeled VMSENSE which is fed into an analog input of the microprocessor. Zener diode ZM6 provides a clamp for the microprocessor input which prohibits the input voltage from reaching destructive levels.

The microprocessor performs analog-to-digital conversions of these three analog signals and calculates a pulse width used to drive transistors QM1 and QM2 which, in turn, drive the motor connected between terminals M+ (QCM2) and M− (QCM3). The microprocessor implements the algorithm described infra. The microprocessor output signal MPWMDRV is a variable pulse width logic level signal whose complement determines the drive duty cycle for the motor. When the MPWMDRV signal is at a logic low, transistor QM2 is in the OFF state. The collector of QM2 is pulled up through load resistor RM1 to the voltage FET_HV. The voltage at the collector of transistor QM2 is connected to the gate of transistor QM1. When the gate voltage rises to a value which exceeds the EMF voltage of the motor by a diode drop plus a MOSFET threshold voltage, MOSFET QM1 begins to conduct current from the VMRAIL supply. As the gate voltage increases above VMRAIL, the motor drive voltage becomes clamped at VMRAIL.

When MPWMDRV goes to a logic high level resistors RM6 and RM8 initially form an attenuator (voltage divider). After transistor QM2 begins to conduct, resistor RM8 determines the base current for QM2. Resistor RM6 acts to enhance the turn-off speed of transistor QM2 by providing a discharge path for the charge stored in the base-emitter region of transistor QM2. As transistor QM2 begins to conduct, the collector voltage is pulled from FET_HV to a saturation voltage above ground. As the gate voltage of transistor QM1 is pulled to ground, it is turned off and conduction of the motor current from the supply VMRAIL ceases. Since the motor is highly inductive, the motor terminal voltage at the M+ terminal immediately rings negatively causing conduction through flyback diode DM2. Conduction continues through diode DM2 until the current from the magnetic energy stored in the motor's windings goes to zero. When conduction in the diode DM2 ceases, the motor is coasting without the presence of any driving voltage and acts as generator producing a terminal voltage (EMF) which is proportional to the motor's speed. Diode DM4 decouples transistor QM1 and the associated drive circuitry from the motor during the segment of time the motor is acting as a generator. Zener diode ZM7 limits the maximum gate-to-source drive voltage applied to transistor QM1 preventing gate breakdown if excessively driven.

Oscillator OSCM1 is a ceramic resonator or quartz crystal which determines the clock frequency for the microprocessor. Resistor RM7 provides a weak leakage path around the resonator or crystal to aid in starting the oscillator. Resistors RM80, RM81, RM82 and RM83 and their associated switches are used to change the firmware configuration of the microprocessor as required, for example, for selecting different fan air flow rates.

The induced draft fan is enabled by the IND_DRV output from the furnace control microprocessor U2. The enabling signal is a pulse train which normally drives a relay through a circuitry arrangement similar to that shown for relay K4. The use of the pulse train is a safety precaution which will turn the fan off in the event of either a stuck at "1" or a stuck at "0" condition failure. In this case the relay is replaced by circuitry which rectifies the pulse train and conditions the signal for use by the motor control microprocessor UM2. Resistor RM23 (FIG. 2*b*) is a pull-up resistor for the relay drive U1 which serves as an inverting buffer. The buffered signal (IDM_DRV) is then AC coupled through capacitor CM11. Resistor RM24 provides a load for the AC coupled signal and provides a DC return path for the subsequent rectification process through diode DM6, resistor RM25, and zener diode ZM10. Diode DM6 rectifies the AC coupled signal. Resistor RM25 limits the current flowing through zener diode ZM10 which limits the voltage to a safe level for the microprocessor input. Capacitor CM12 provides filtering for the rectified wave form. The resulting signal is applied to an input of motor control microprocessor UM2.

Microprocessor UM2 compares the fan motor's EMF and current against limits stored in its memory to determine if air flow is adequate to provide safe combustion characteristics for the gas furnace. If adequate air flow exists, microprocessor UM2 outputs a pulsed drive signal to transistor QM3 through base current limiting resistor RM21. The use of a pulsed drive signal is a safety measure which will cause the relay to release if either a stuck at "1" or a stuck at "0" condition develops for the enabling signal. Transistor QM3, resistor RM20, and diode DM5 invert and buffer the drive signal. When the collector of transistor QM3 is pulled up by the supply RLAY_PWR, capacitor CM8 is charged through diodes DM3 and DM5 and resistor RM20. When transistor QM3 is turned on, its collector is pulled to a saturation voltage above ground. Pulling the positive terminal of capacitor CM8 to near ground causes its negative terminal to go to a negative potential whose magnitude is slightly less than the magnitude of the RLAY_PWR supply. Diode DM3 is reverse biased and conduction through DM3 ceases. The capacitor CM8 begins to discharge through the coil of relay KM1 which energizes to the relay. When the charge-discharge cycle is repeated rapidly, the relay will remain energized. The contacts of relay KM1, under the control of the microprocessor, replace the contacts of a conventional pressure switch, as will be discussed further below.

With reference to FIG. 2*a*, the enabling signal for the furnace control is the Call for Heat (W) signal from the room thermostat. When the thermostat switch closes, the transformer secondary line R is connected through the closed thermostat switch to the terminal labeled W. If the pressure simulation switch which is normally connected between the PSIN and PSOUT is closed, the 24 volts AC will now be present on one of the contacts of the gas valve relay K4. Relay K5 turns on the gas ignitor prior to energizing the gas valve relay to permit the ignitor to reach ignition temperature prior to releasing gas. Following this delay the gas valve relay is energized which opens the gas valve and combustion is initiated.

As described in greater detail in coassigned U.S. Pat. No. 5,272,427, the subject matter of which is incorporated herein by this reference, various 24 volt AC furnace signals are read by microprocessor U2. The voltage sampling procedure is complicated by the requirements for grounding the transformer secondary common (C) lead and the gas valve solenoid to chassis ground. The full wave bridge rectifier which is formed by diodes CR1, CR2, CR3, and CR4 establishes the logic ground reference. When observing the R or C lines from the transformer secondary with respect to logic ground, the wave forms appear to be half wave rectified wave forms which have the negative half cycle of the wave form clipped at a diode drop below logic ground. The presence of the thermostat switch closure is detected by the microprocessor through an attenuator circuit formed by resistors R7 and R35. Resistor R5 limits current through the clamp diodes at the microprocessor input. When the thermostat switch is open, the voltage at the junction of R7 and R35 with respect to logic ground is a half sinusoid which has a peak amplitude of approximately 40 volts. When the thermostat switch closes the voltage wave form at this node is made up of two half wave rectified peaks which appear as unequal amplitude full wave rectified half cycle peaks. The peak from the thermostat input has an amplitude of $$V_{peak}\ [R35/(R7+R35)]$$

while the peak from the chassis ground input has an amplitude of $$V_{peak}\ [R7/(R7+R35)].$$

In order to detect the presence or absence of the half cycle peak from the W line, the microprocessor must make a determination of the appropriate time to obtain a signal sample. This is determined by a sample from the R side of the transformer secondary. This signal is attenuated by the divider formed by resistors R2 and R20. Resistor R2 also limits the current through the input clamp diodes in the microprocessor. Capacitor C4 provides filtering of high frequency signal components associated with this signal. This signal, which is a positive half cycle of the AC supply, is clipped at the VDD level for the microprocessor. This signal is fed to the Interrupt Request line and to an input of the microprocessor. On the falling edge of this waveform, the IRQ signal for the microprocessor is activated which initiates a counter in the microprocessor that counts until this wave form on the microprocessor inputs reaches a half cycle or a full cycle transition boundary. This count effectively determines the period of the AC supply. Based upon this value, the sampling point for the peak of the half cycle due to the presence of an AC wave form at W is determined. Similar circuits are used at the nodes following the pressure simulation switch function and the signal fed back from across the gas valve solenoid. The fan control input (G) from the thermostat is also sensed by the microprocessor by an identical method.

An additional safety interlock subsystem which utilizes thermal switches 21 shown in FIG. 1 located in various key locations on the furnace is indicated by the terminals designated LIMIT_IN and LIMIT_OUT. LIMIT_IN provides a fused source of 24 volts AC which is passed through a string of normally closed limit switches referenced above to the LIMIT_OUT terminal. The LIMIT_OUT terminal then supplies power to the thermostat. If any of the thermal limit switches open, power is removed from the thermostat which will inhibit furnace operation. The microprocessor also detects the open thermal limit switch directly via resistor R6 which limits current through the input clamping diodes of the microprocessor. Resistor R18 is a load resistor.

The gas valve closure signal is also passed to the motor control microprocessor UM2 via cascaded inverters in U3 in order to avoid unsafe operation in the event of a failure of furnace control microprocessor U2. When the gas valve is off, half cycle pulses from chassis ground couple through the deenergized solenoid coil into the gas valve sample terminal GV. When the solenoid is energized, the half cycle supplied by the R lead via the limit switches, thermostat, pressure switch (or the equivalent), and gas valve relay becomes the signal at the GV terminal. The impedance of the solenoid effectively blocks the half cycle from the chassis ground. Thus the wave form at the GV input appears to change half cycle positions when the gas valve is energized. The inverters in U3 limit the amplitude of the output signal MV3 to a logic level swing. The 24 volt AC signal relative to logic ground is a half cycle peak corresponding to the positive half cycle at R. Resistor RM90 and diode DM90 effectively perform a logic AND function between MV3 and the positive half cycle of R which corresponds to the signal condition for a closed gas valve. Resistors RM90 and RM91 attenuate the MV3 signal while RM90 will limit the clamp diode current in the input of the microprocessor UM2 if the signal MV3 exceeds the input range. Capacitor CM90 and diode DM91 provides filtering. Resistors RM92 and RM93 form an attenuator for the 24 volt AC signal which is applied to the interrupt request line (MIRQ) for the motor control microprocessor UM2. RM92 provides current limiting for the clamping diodes in the input circuitry of microprocessor UM2. Capacitor CM91 provides filtering.

The reset line for the microprocessor U2 is driven from the 24LOGIC supply through a voltage dropping zener diode CR28 and an attenuator formed by resistors R28 and R30. A clamping zener diode CR6 limits the input voltage to the microprocessor. Capacitor C9 delays the rise of the reset wave form from that of the 24LOGIC supply and the VDD supply for the microprocessor.

Oscillator OSC1 is a ceramic resonator which determines the oscillator frequency for the microprocessor. The internal timing for the microprocessor is determined by this frequency. Resistor R10 is a leak resistor which aids in starting the oscillator.

The twinning circuitry utilizes a microprocessor output and an input in conjunction with resistors R41, R42, R43, and R51, zener diode CR12, and a relay driver in U1. The twin connection is a bidirectional interlock port for synchronizing the operation of two furnaces when desired.

Microprocessor outputs buffered by relay drivers in U1 control various relays which in turn control various components of the gas furnace. Relay K1 enables the air handler blower. Relay K2 selects the blower speed. Relay K5 enables the ignitor, and relay K4 enables the gas valve after a suitable time delay.

A buffered microprocessor output also flashes LED1 which is used for diagnostic reporting. Resistor R29 limits the LED current. The 90+_IN terminal is a configuration port which configures the internal microprocessor firmware for two types of furnaces having slightly different characteristics.

The flame sense circuit is comprised of capacitors C5 and C6, resistors R11, R22, and R26, and an inverter from U3. The flame acts as a high value resistor in series with a diode whose cathode is connected to chassis ground. The line voltage AC wave form is clipped to a value dependent upon the reactance of capacitor C6, the value of resistor R25, and the equivalent resistance of the flame. The rectification causes the average value of the voltage at the R22, R26, and C6 node to become negative. Prior to the initiation of flame, resistor R11 charges capacitor C5 to VDD. With flame present the negatively biased node described above discharges capacitor C5. As the capacitor voltage drops below the threshold voltage for the inverter, the presence of flame is declared and fed to an input of microprocessor U2 through resistor R90. Resistor R27 and diode C13 are connected in series between a microprocessor output and the signal node of capacitor C5. A test mode is periodically initiated when flame is present by locking out the shutdown procedure if flame is not detected and charging capacitor C5 to VDD from the microprocessor output through resistor R27 and diode CR13. Transitions out of the flame sense mode and back into the flame sense mode may be evaluated to indicate possible improper flame sense operation. This flame test is also disclosed in copending application Ser. No. 08/251,816, assigned to the assignee of the present invention, the subject matter of which is incorporated herein by this reference.

Figure 3:
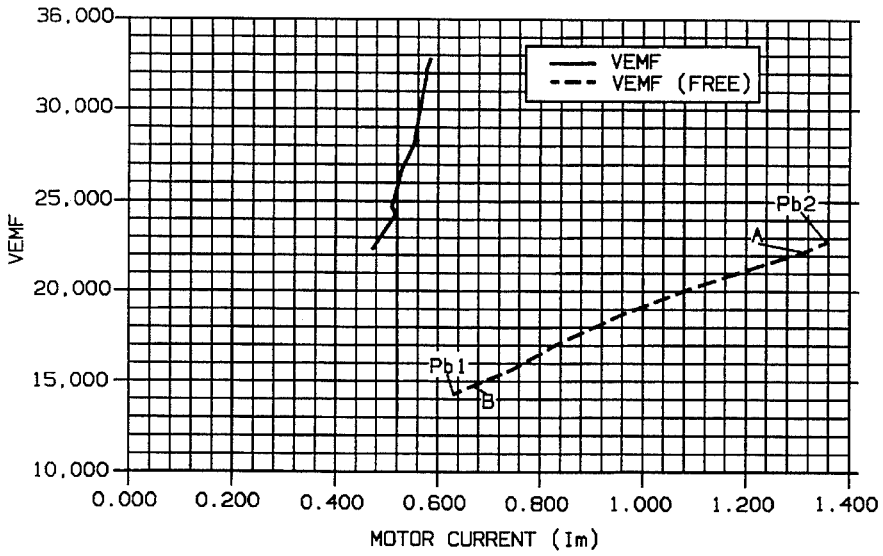
FIG. 3 is a plot of $V_{EMF}$ vs motor current for a motor driving a fan as well as for an unloaded motor.

With reference to FIG. 3, each point on the curve which includes points A and B corresponds to an operating point for a particular fan at a selected flow rate of 21 CFM (cubic feet per minute). If, at a given point for the referenced fan, the actual $V_{EMF}$ is above the curve, then the duty cycle must be raised to increase the load on the fan and bring the actual operating point closer to the new point on the curve. The reverse applies if the actual $V_{EMF}$ is below the curve for a specific current.

The control process is iterative. Motor current $I_M$ is used to compute a desired voltage, the actual $V_{EMF}$ is subtracted from the desired voltage to get a relative error, and the duty cycle is adjusted according to the direction and magnitude of the error. After giving the motor some time to settle into the new duty cycle, the process is repeated continually attempting to bring the operating point onto the curve.

There is a window of motor current $I_M$ values for which the control system is valid. Below a certain motor speed, the $I_M$ vs $V_{EMF}$ curve is unpredictable. The curve also reaches a maximum peak as the duty cycle increases, beyond which the curve drops off. For this reason, high and low limits are placed on motor torque, motor speed and PWM duty cycle and frequency.

Figure 4:
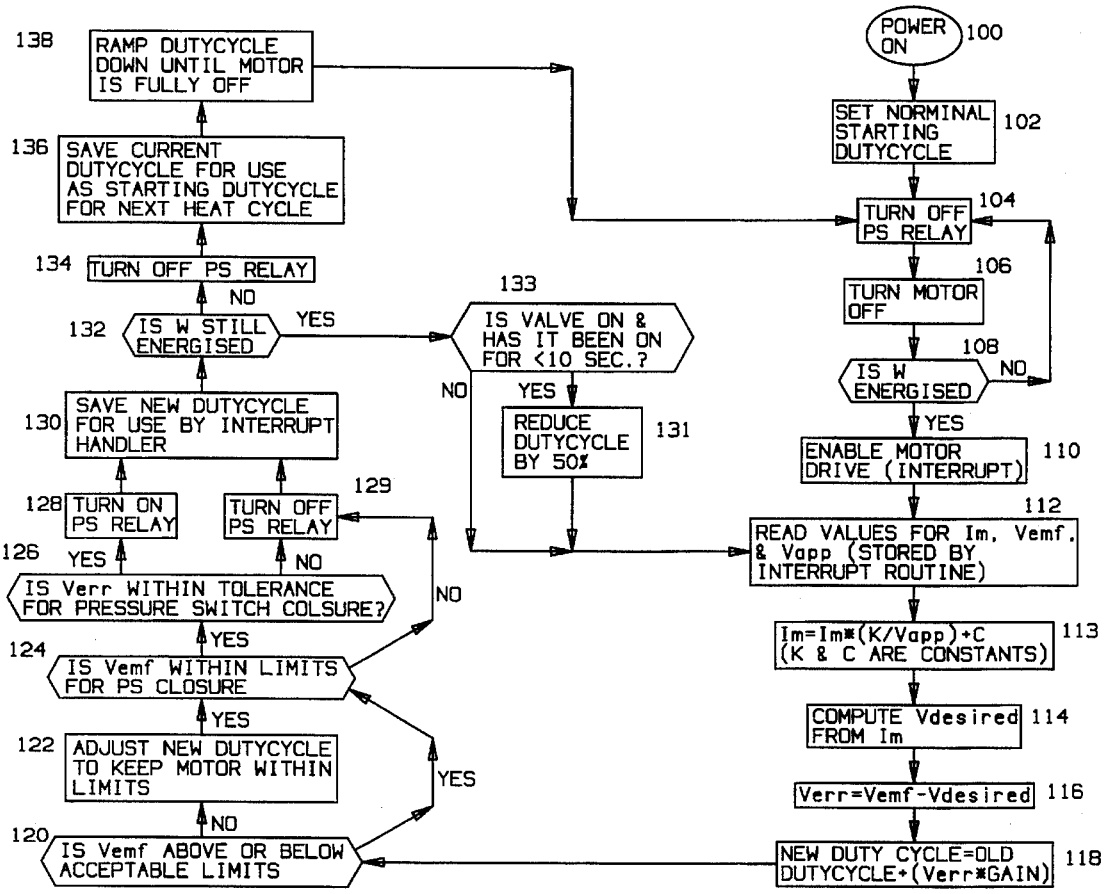
FIG. 4 is a flow chart showing the main routine of the microprocessor control.
Figure 5:
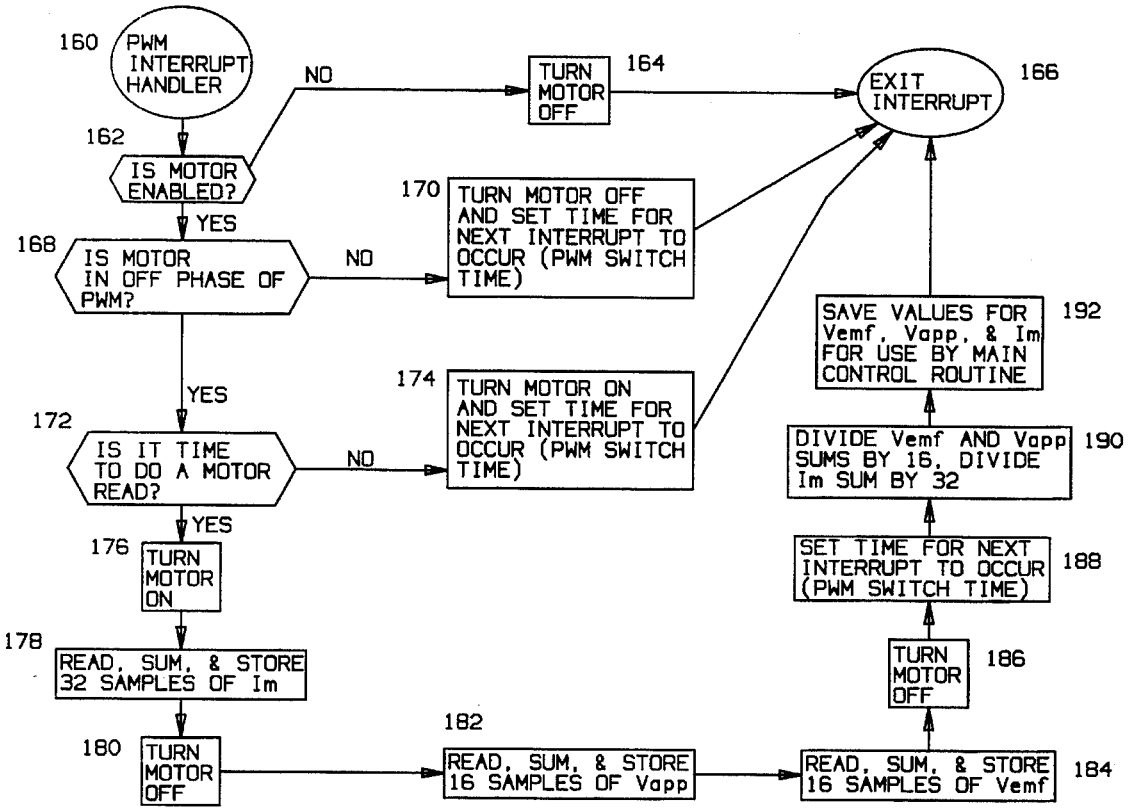
FIG. 5 is a flow chart showing the interrupt handler which produces the actual PWM waveform and measures the motor parameter for use by the FIG. 4 routine.
Figure 6:
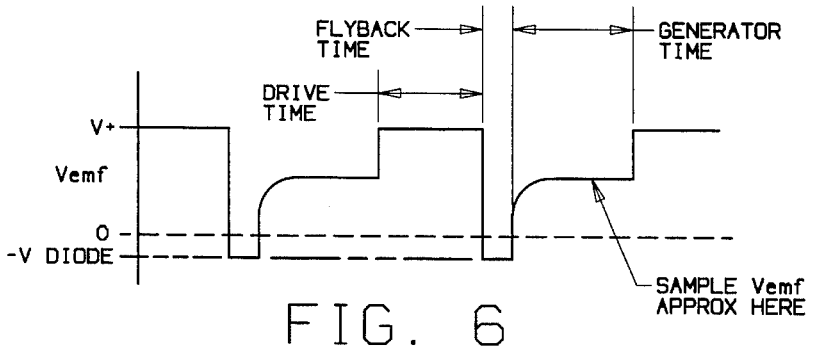
FIG. 6 shows a wave form during the reading of the parameters.

FIGS. 4 and 5 show a basic flow chart for the microprocessor code in a preferred embodiment. FIG. 4 describes the main routine, which is executed continuously. FIG. 5 describes the interrupt handler which produces the actual PWM waveform and measures the motor parameters for use by the main routine. The interrupt handler takes control from the main routine on a periodic basis when it is time to switch the state of the motor drive.

With reference to FIG. 4, when the controller is energized at 100, it sets a nominal starting duty cycle (e.g. 20%) as shown at 102. The next steps 104 and 106 ensure that the low pressure relay KM1 and the induced draft fan motor are both turned off. At decision block 108, if no thermostat signal W requesting heat is received, the routine goes back to step 104 and stays in that loop. Once the thermostat signal W calling for heat is received then, at 110, the motor drive is enabled. At 112, values for motor current ($I_m$), motor EMF voltage ($V_{emf}$), and applied motor voltage (Vapp) are read from memory. These values are constantly updated by the interrupt handling routine shown in FIG. 5 to be discussed infra. At 113, the most recent motor current reading ($I_m$) is adjusted by a feed forward voltage compensation algorithm to compensate for variations in the applied voltage (Vapp), e.g., covering a range from 18 to 30 volts AC, by the equation $I_m$ (compensated)=$I_m$*(K/Vapp)+C where K and C are constants particular to a given motor/fan combination. This combination ensures that $I_m$ is an accurate representation of motor torque regardless of applied voltage. The desired EMF voltage (Vdesired) is computed at 114 from motor current Im utilizing a programmed curve of $I_m$ vs Vemf for a selected air flow rate and a selected fan/motor combination which is stored in the microprocessors memory prior to shipment. The error voltage (Verr) is computed in 116 by subtracting the Vdesired from Vemf. At 118, the new duty cycle is computed by adding the error voltage Verr multiplied by a gain to the current duty cycle with the gain proportional to the magnitude of error voltage Verr so that a smooth, fast response time is obtained for the system. A decision is made at 120 as to whether the motor EMF voltage Vemf is within tolerable limits for proper motor operation and if not, the duty cycle is adjusted at 122 to attempt to bring the motor within tolerable limits. Regardless of the decision made at 120, a new decision is made at 124 to determine if the motor EMF voltage Vemf is within range for pressure switch relay (PS) closure and if not then the flow skips to 129. Otherwise, a new decision is made at 126 as to whether the error voltage Verr is within tolerance for PS relay closure and if so, the PS relay (KM1) is energized. If the decisions at 120 or 126 are negative, then the PS relay (KM1) is turned off. Flow resumes at 130 where the newly computed duty cycle is saved for use by the interrupt handler. At step 132, if W is still on, then flow proceeds to step 133, otherwise the PS relay is turned off at 134, and the current duty cycle is saved at 136 as a starting point for the next cycle to reduce the settling time of the system on that cycle. At 138, the duty cycle is ramped down to zero over a short span of time (e.g. 2 seconds) to turn the motor off prior to restarting the process at 104. If the decision at 132 is true, then at 133 a decision is made as to whether the valve is on and has been on for less than a specified period (e.g. 10 seconds) and if the decision is true, then the duty cycle to the motor is reduced by a nominal percentage (e.g. 50%) at 131, typically 5–10 seconds, to allow for a more stable ignition or a "soft start ignition" of the gas/air mixture. If the decision at 133 is not true, then the duty cycle is not altered, and program flow continues at block 114.

With reference to FIG. 5, the interrupt handler routine is entered at 160 whenever the timer signals that it is time for another interrupt. At 162, if the motor is not enabled, then the motor is turned off at 164 and the interrupt is exited at 166 otherwise a decision is made at 168 as to whether the motor is currently in the off-phase of PWM operation. If the decision at 168 is false, then the motor is turned off at 170 and the interrupt timer is set to signal the next interrupt at the appropriate time based on the current duty cycle and PWM period prior to exit at 166. If the decision at 168 is true, then at 172 a decision is made as to whether or not it is time to read the motor parameters and if not then the motor is turned on at 174 and the interrupt timer is set to signal the next interrupt at the appropriate time based on the current duty cycle and PWM period prior to exit at 166. If the decision at 172 is true then, at 176, the motor is turned on and, at 178, 32 samples of motor current Im are read, summed, and stored for later processing. At 180, the motor is turned off prior to reading, summing, and storing 16 samples of applied voltage Vapp at 182. At 184, 16 samples of motor EMF voltage Vemf are read, summed, and stored prior to turning the motor back on at 186 and setting the interrupt timer to signal the next interrupt at the appropriate time at 188. At 190, the sums for Vemf and Vapp are divided by 16 to produce an average value for the two variables and the sum for Im is divided by 32 for averaging purposes prior to saving values for Vemf, Im, and Vapp for use by the main routine at 192 and exiting the handler at 166.

During the sampling period a suitable duty cycle (e.g. 504) is employed for reading the samples. Since the sampling process alters the operation of the motor, each sample period is separated by at least N PWM cycles where N is chosen to be between 10 and 1000 depending on PWM frequency. By way of example in a system made in accordance with the invention with a PWM frequency of 200 Hz, N is 32.

Under normal operation the duty cycle will come up to close to the same level. Going through the rest of the routine becomes relevant only if the back pressure of the system changes as by a partial blockage of the vent due to a the existence of a bird's nest or the like. Upon initial energization of the system the routine may take a minute or two reach optimization, however, once that occurs the system adapts to changes in back pressure very quickly, i.e., a matter of seconds.

The flow chart of FIG. 4 described above provides low pressure protection without the use of a conventional low pressure sensor 32 shown in FIG. 1. Such pressure sensors are relatively expensive as well as adding to potential field problems. The function of pressure switch 32 is to ensure that the venting system is operational and hazardous combustion gases such as carbon monoxide will not be forced into the heated air space. The pressure switch is responsive to a number of conditions including blocked or highly restricted vents, induced draft fan failure, inadequate induced draft fan performance and loose fan impellers.

As set forth above, the sampled electromotive force $V_{EMF}$ of a DC motor provides feedback which is linearly proportional to the speed (RPM) of the motor. Current $I_m$ drawn by the motor is similarly linearly proportional to torque generated by the motor. A known fan equation is as follows:

$$T \times N = P \times Q$$

where T=torque produced by the motor
N=motor speed (RPM)
P=static pressure for the fan
Q=volumetric air flow (CFM)

For a constant air flow rate and measurements of $V_{EMF}$ and $I_m$ which are linearly proportional to N and T respectively, the above equation can be satisfied to ensure that adequate back pressure and flow rate exist for safe furnace operation by establishing limits for $V_{EMF}$ and $I_m$. As seen in FIG. 3, the curve indicated by the square data point shows data typical of desired motor operation for a constant flow rate of 21 CFM over a back pressure range of $P_{b1}$ of 0.049 inches of water to $P_{b2}$ of 1.891 inches which adequately covers the desired back pressure range. Maximum back pressures are typically 0.5 inches for presently designed furnaces.

The blocked or partially blocked vent can be detected and inhibited by prohibiting operation above a selected value of $V_{EMF}$ and $I_m$ point on the curve which correspond to the maximum allowable back pressure. The point labeled A in the figure represents such a point.

Operation with a failed induced draft fan or with inadequate flow or back pressure can be inhibited by requiring operation above a $V_{EMF}$ and $I_m$ point on the operating curve which corresponds to the minimum acceptable back pressure at the desired flow rate for the fan. The point labeled B in the figure represents such a point.

The loose impeller can be detected by requiring a minimum motor current to enable furnace operation. Under this condition the motor is operating without a load. The curve indicated by the circles in FIG. 3 represents reduced current drawn by the motor under unloaded conditions.

A control system made in accordance with the FIG. 2 embodiment comprised the following components. The components shown in FIG. 2*a:*

| | | | | | |
|---|---|---|---|---|---|
| U1 | ULN2003<br>50 V | R1 | 1.5K ohms<br>5% 1 W | R27 | 10K ohms<br>5% ⅛ W |
| U2 | 68HC05P7 | R2 | 100K ohms<br>5% ⅛ W | R12 | 51K ohms<br>5% ⅛ W |
| U3 | CD4069 | R3 | 100K ohms<br>5% ⅛ W | R13 | 1.5K ohms<br>5% 1 W |
| K1 | T90 SPST SL<br>22 V | R4 | 100K ohms<br>5% ⅛ W | R14 | 470 ohms<br>5% 2 W |
| K2 | T70 SPDT<br>18 V | R5 | 100K<br>5% ⅛ W | R16 | 2K ohms<br>5% ⅛ W |
| K4 | T70 SPDT<br>12 V | R6 | 100K ohms<br>5% ⅛ W | R18 | 10K ohms<br>5% ⅛ W |

-continued

| | | | | | |
|---|---|---|---|---|---|
| K5 | T70 SPDT<br>18 V | R7 | 470 ohms<br>5% 2 W | R19 | 100K ohms<br>5% ⅛ W |
| OSC1 | 2.0 MHZ | R8 | 51K ohms<br>5% ⅛ W | R20 | 100K ohms<br>5% ⅛ W |
| F1 | 3 amp | R9 | 470<br>5% 2 W | R22 | 7.5 MEG ohms<br>5% ⅛ W |
| LED1 | RED | R10 | 39K<br>5% ⅛ W | R24 | 2K ohms<br>5% ⅛ W |
| | | R11 | 5.1 MEG ohms<br>5% ⅛ W | R26 | 1.0 MEG ohms<br>5% ⅛ W |
| R28 | 5.1K ohms<br>5% ⅛ W | R47 | 100K ohms<br>5% ⅛ W | CR8 | 1N4007<br>1 amp |
| R29 | 10K ohms<br>5% ⅛ W | R51 | 100K ohms<br>5% ⅛ W | CR10 | 1N4007<br>1 amp |
| R30 | 5.1K ohms<br>5% ⅛ W | R90 | 2K ohms<br>5% ⅛ W | CR11 | 1N4007<br>1 amp |
| R31 | 10K ohms<br>1% ¼ W | CR1 | 1N4007<br>1 amp | CR12 | 1N5262<br>5% 51 V ½ W |
| R35 | 160K ohms<br>5% 1 W | CR2 | 1N4007<br>1 amp | CR13 | 1N458A |
| R36 | 160K ohms<br>5% 1 W | CR3 | 1N4007<br>1 amp | CR14 | 1N4007<br>1 amp |
| R41 | 51K ohms<br>5% ⅛ W | CR4 | 1N4007<br>1 amp | CR16 | 1N4007<br>1 amp |
| R42 | 2K ohms<br>5% ⅛ W | CR5 | 1N4007<br>1 amp | CR28 | 1N5242b<br>5% 12 V ½ W |
| R43 | 100K ohms<br>5% ⅛ W | CR6 | 1N5231b<br>5% 5.1 V ½ W | C1 | 47 uF |
| R46 | 10K ohms<br>5% ⅛ W | CR7 | 1N5231b<br>5% 5.1 V ½ W | C2 | 10 uF<br>20% 16 V |
| C4 | .01 uF<br>5% 50 V | C5 | .1 uF<br>5% 50 V | C6 | 1000 pF<br>10% 1 KV |
| C9 | 10 uF<br>20% 16 V | C10 | 0.1 uF<br>10% 100 V | C11 | 0.1 uF<br>10% 100 V |
| C12 | 0.1 uF<br>5% 50 V | C15 | 47 uF<br>20% 50 V | C20 | 0.1 uF<br>20% uF |
| C21 | 0.1 uF<br>20% 250 V | | | | |

The components shown in FIG. **2*b*:**

| | | | | | |
|---|---|---|---|---|---|
| UM1 | LM224<br>OPAMP | QM1 | RFD14N05 | RM1 | 51.0K ohms<br>1% ¼ W |
| UM2 | ST6210B6 | QM2 | MPSA06 | RM3 | 1.5K ohms<br>5% 1 W |
| MOVM1 | SO5K35<br>35 V | QM3 | MPSA06 | RM4 | 10K ohms<br>5% 2 W |
| KM1 | T70 SPDT<br>12 V | CM3 | .1 uF<br>50 V | RM5 | 10K<br>1% ¼ W |
| LEDM1 | RED | CM4 | .01 uF<br>50 V | RM6 | 4.7K<br>1% ¼ W |
| OSM1 | 4.0 MHZ | CM5 | 47 uF<br>50 V | RM7 | 1 Mega ohms<br>5% ⅛ W |
| ZM4 | 1N5231<br>5% 5.1 V ½ W | CM6 | 47 uF<br>50 V | RM8 | 10K ohms<br>1% ¼ W |
| ZM5 | 5% 5.1 V ½ W | CM7 | .1 uF<br>20% 100 V | RM9 | 10K<br>1% ¼ W |
| ZM6 | 1N531<br>5% 5.1 V ½ W | CM8 | 47 uF<br>20% 50 V | RM10 | 4K ohms<br>5% ⅛ W |
| ZM7 | 1N5247<br>5% 12 V ½ W | CM9 | 0.1 uF<br>20% 50 V | RM11 | 10K ohms<br>1% ¼ W |
| ZM9 | 1N5231<br>5% 18 V ½ W | CM11 | 0.1 uF<br>20% 100 V | DM1 | 1N4007<br>1 amp |
| ZM10 | 1N5231<br>5% 5.1 V ½ W | CM12 | 0.1 uF<br>20% 100 V | DM2 | 1N4007<br>1 amp |
| DM3 | 1N4007<br>1 amp | RM12 | 10K ohms<br>5% ¼ W | CM20 | 0.1 uF<br>20% 100 V |
| DM4 | MBR350<br>3 amp | RM13 | 0.1 ohms<br>5% 3 W | CM21 | 4700 uF<br>10% 50 V |
| DM5 | 1N4007<br>1 amp | RM14 | 10K ohms<br>1% ¼ W | CM90 | 0.1 uF<br>20% 100 V |
| DM6 | 1N4007<br>1 amp | RM15 | 47K ohms<br>1% ¼ W | CM91 | 0.1 uF<br>5% 50 V |
| DM90 | 1N4007<br>1 amp | RM18 | 75K ohms<br>5% ¼ W | CC2 | .47 uF<br>50 V |
| DM91 | 1N4007<br>1 amp | RM19 | 20K ohms<br>5% ¼ W | CC5 | 10 uF<br>50 V |

-continued

| | | | | | |
|---|---|---|---|---|---|
| DMB1 | MBR350<br>3 amp | RM20 | 470 ohms<br>5% 2 W | RM21 | 100K ohms<br>5% ⅛ W |
| DMB2 | MRB350<br>3 amp | RM23 | 100K ohms<br>5% ⅛ W | RM24 | 51K ohms<br>5% ⅛ W |
| DMB3 | MRB35<br>3 amp | RM25 | 51K ohms<br>5% ⅛ W | RM26 | 100K ohms<br>5% ⅛ W |
| DMB4 | MRB350<br>3 amp | RM27 | 10K ohms<br>5% ⅛ W | RM90 | 100K ohms<br>5% ⅛ W |
| DD4 | 1N4007 | RM91 | 100K ohms<br>5% ⅛ W | RM92 | 100K ohms<br>5% ⅛ W |
| FM1 | 5 amp | RM93 | 100K ohms<br>5% ⅛ W | RM99 | 2K ohms<br>5% ⅛ W |
| DD2 | 1N4007<br>1 amp | RR1 | 1M ohms<br>5% ⅛ W | RR3 | 100 ohms<br>5% ⅛ W |
| RM28 | 470 ohms<br>5% 2 W | RM80 | 2K ohms<br>5% ⅛ W | RM81 | 2K ohms<br>5% ⅛ W |
| RM82 | 2K ohms<br>5% ⅛ W | RM83 | 2K ohms<br>5% ⅛ W | | |

According to a modified embodiment of the invention, the data sampling process "piggy backs" onto the pulse width modulated wave form. In this embodiment the PWM wave form received by the motor is not changed by the sampling process. During the sampling process, the control first waits for the motor to turn on and then continually takes samples of motor current until the motor turns off again. As soon as the motor turns off, the control starts sampling the EMF voltage and continues to do so until the motor turns on again. The actual number of samples for each parameter depends on the duty cycle of the motor. Preferably, the applied voltage is also read the same way as the motor current but during a different cycle. The reading of all three parameters constitutes a complete sample period. After a complete sample period, all of the motor current data is summed and averaged over the entire PWM period. The EMF voltage is compared to a threshold to eliminate erroneous data during the flyback time. All values which exceed the threshold are averaged together. The applied voltage values are simply averaged. All three data values are then averaged with the data from previous sample periods to smooth the input signals.

Although the preferred embodiments described above utilize a DC motor having brushes, it is within the purview of the invention to utilize a brushless DC motor or AC motor driven fans by using a variable frequency generator to drive the fan motor and thus control its speed. Further, it will be appreciated that the invention can be used with furnace systems of various types with which an induced draft fan is employed. Further still, although the operation is described without the use of a pressure switch, it will be realized that, if desired, a low pressure switch as shown in FIG. 1 can be utilized. Although the preferred embodiments describe the use of EMF voltage to determine motor speed and motor current to determine motor torque, any alternate means of measuring motor speed, such as by use of a Hall effect sensor, a motor torque, such as by measuring the change of motor speed over time, comes within the purview of the invention.

Various additional changes and modifications can be made in the above described details without departing from the nature and spirit of the invention. It is intended that the invention not be limited to said details except as set forth in the appended claims.

What is claimed:

1. A gas furnace system having a combustion chamber, a gas valve to supply gas to the combustion chamber, an ignitor, a heat exchanger including a vent, an induced draft fan driven by an electric motor to bring air into the combustion chamber and to expel combustion gases through the vent, a controller including a microprocessor for controlling energization of the ignitor and the electric motor, a thermostat coupled to the controller, the microprocessor having a memory location, operating values of the electric motor comprising a curve of a first variable proportional to motor speed vs a second variable proportional to motor torque for the motor used to drive a given fan over a selected range of back pressure for at least one selected rate of flow value stored in the memory location prior to installation of the motor in the system, minimum and maximum operating values relating to minimum and maximum back pressures chosen to provide an acceptable range of operating values of the electric motor, means to read data values of the actual first and second variables and to compare the actual data values with the minimum and maximum operating values and means to deenergize the system if the actual data values are not within the acceptable range.

2. A gas furnace system according to claim 1 in which the electric motor is a DC motor.

3. A gas furnace system according to claim 1 in which the first variable proportional to motor speed is $V_{EMF}$ of the motor and the second variable proportional to motor torque is motor current.

4. A gas furnace system having an induced draft fan, an ignition control and a power supply, a control apparatus for maintaining a constant flow rate of induced combustion air for mixture with a selected flow of gas comprising:

an electric DC motor, an induced draft fan coupled to the motor, pulse width modulation means connected to the motor for supplying a PWM voltage wave having a duty cycle to drive the motor, a microprocessor having input ports and output ports, means to measure a first actual variable signal proportional to motor speed and to couple the first actual variable signal to an input port of the microprocessor, means to measure a second actual variable signal proportional to the actual motor torque and to couple the second actual variable signal to an input port of the microprocessor, the microprocessor having a memory location and stored values of the first variable signal vs the second variable signal for a selected rate of air flow provided by the induced draft fan over a range of back pressures, the microprocessor having means to compare actual first variable signal with the stored first variable signal for the actual second variable signal to produce a relative error signal, the microprocessor providing an input at an output port coupled to the pulse width modulation means to adjust the duty cycle of the PWM voltage wave to change speed of the motor based on the relative error signal.

5. A gas furnace control system according to claim 4 in which the first variable speed proportional to motor speed is electromotive force (EMF) motor voltage and the second variable signal proportional to motor torque is motor current.

6. A gas furnace control system according to claim 5 including a low impedance resistor serially connected between the motor and ground forming a voltage divider network with the motor and the means to measure the second variable signal comprises measuring the voltage across the low impedance resistor.

* * * * *